US005191678A

United States Patent [19]

Firari

[11] Patent Number: 5,191,678

[45] Date of Patent: Mar. 9, 1993

[54] WIND RESISTANT DOOR HARDWARE

[75] Inventor: Harold A. Firari, Wauwatosa, Wis.

[73] Assignee: T.J. Firari Enterprises, Milwaukee, Wis.

[21] Appl. No.: 711,722

[22] Filed: Jun. 10, 1991

Related U.S. Application Data

[63] Continuation-in-part of Ser. No. 428,722, Oct. 30, 1989, abandoned.

[51] Int. Cl.[5] ..... E05F 1/08

[52] U.S. Cl. ..... 16/305; 16/307; 16/76

[58] Field of Search ..... 16/305, 307, 373, 278, 16/76, 85

[56] References Cited

U.S. PATENT DOCUMENTS

| | | | |
|---|---|---|---|
| 721 | 4/1838 | Hoyt et al. | 16/305 |
| 1,593,724 | 7/1926 | Schenk | 16/307 |
| 1,745,773 | 2/1930 | Sipe . | |
| 1,925,945 | 9/1933 | Zielinski et al. | 16/76 |
| 1,931,271 | 10/1933 | Simmons . | |
| 2,150,435 | 3/1939 | Floreth | 16/76 |
| 2,309,279 | 1/1943 | Smythe . | |
| 3,178,762 | 4/1965 | Whiting . | |
| 3,538,539 | 11/1970 | Allison . | |
| 4,377,019 | 3/1983 | Takahashi . | |

FOREIGN PATENT DOCUMENTS

| | | | |
|---|---|---|---|
| 469612 | 5/1914 | France | 16/305 |

*Primary Examiner*—Robert L. Spruill
*Assistant Examiner*—Carmine Cuda
*Attorney, Agent, or Firm*—Wheeler Law Firm

[57] ABSTRACT

A spring loaded door hinge comprising a rod that moves with the door as the door pivots. Attached to the door frame is a flange. The door is attached to the rod by means of collars. The tails of the coil springs extend from the rod so that they may, depending upon their position, be in position to strike the door frame flange thereby preventing a large shock from being transferred to the door if it is swung open violently. Also the spring hinge allows the door to be easily opened initially with resistance to the door opening being controlled by the positioning of the tails of the coil springs. The springs are distributed vertically to prevent twisting of the door and frame. The tails of the spring coils are hooked so that the can engage the door frame flange if extreme force is placed upon the door when opening. The hooks set a limit as to how far the door may be opened and prevent the spring tail from binding between the flange and the spring coil.

14 Claims, 3 Drawing Sheets

WIND RESISTANT DOOR HARDWARE

This application is a continuation-in-part, of application Ser. No. 07/428,722 filed 30 OCT. 1989, now abandoned.

BACKGROUND OF THE INVENTION

The present invention relates to the field of door hinges. Specifically, it relates to door hinges used on the outer doors of commercial buildings.

The outer doors of a commercial building ordinarily do not have any latch to hold a door closed. Such doors are usually mounted on pivots and are controlled only by a door closing device which provides uniform or substantially uniform spring force to close the door. This force cannot be very high because it is essential that a person be able to push on the door without exerting great force to open it easily. However, the fact that the door must be designed to yield easily to a person pushing or pulling on it also means that it is easy for the wind to blow the door open; slamming it to its farthest opened position. This causes damage to the door, the door frame, and in extreme cases to adjacent glass panels.

The applicant by means of a unique and simple modification to the hinge structure of a door has created a door pivot which allows a door to operate under the control of a door closing device for most of its travel but will apply a very heavy progressive spring force to the door as it nears the wide open position. This allows the door to be brought to a gradual, rather than sudden, stop when an usually heavy force, like a blast of wind, causes the door open. This is an improvement over the conventional solutions to the problem of the door being violently swung open. This is because conventional solutions to this problem usually only increase the spring force directly against the door through its entire opening movement. However, that only makes the door more difficult to operate.

The applicant knows of no other prior art which has the same structure or functions in the same manner as his invention. For example, U.S. Pat. No. 4,377,019 (Takahashi), shows a vertical bar extending the full height of the door with a coil spring wrapped around it. However, the free end of the coil spring is attached to the door (or whatever is on the hinge) so the spring acts full time to impede the progress of the door rather than just before the farthest open position as does the applicant's invention. U.S. Pat. No. 2,309,279 (Smythe), likewise shows a spring that acts full time although its conical winding makes it stronger through part of its movement. The purpose is totally different from that of the applicant's invention in that the Smythe patent is not a true hinge but a device which moves partly around a pivot and partly in another direction so that the lamp globe can move against a gasket in a direction that does not distort the gasket. This is very different from the structure of the applicant's invention. U.S. Pat. No. 1,931,271 (Simmons), does show a spring that is effective at the end of the swing of the door. The door has a part 20 which is a half circle. The part strikes the flat spring 26. However, the Simmons patent does not show the principle on which the applicant's device operates nor does it show the same structure. U.S. Pat. No. 1,745,773 (Sipe), works on a similar principal to the Simmons patent. However Sipe has a strip 19 which is made of material like rubber which is designed to engage the inner wall 17*a* of the recess 17 thereby stopping the movement of the door. Both the Simmons patent and the Sipe patent are different in structure from the applicant's invention. They function as shock absorbers when the door is pushed open roughly. The applicant's invention functions as a shock preventer by gradually increasing the amount of force required to swing the door when it is most nearly open. As such the applicant's invention provides resistance to the door swinging open wildly by allowing low resistance when the door is just opened and having that resistance increased rapidly when the door almost reaches its maximum opening swing. The Simmons patent and the Sipe patent are designed to absorb the shock of a door that swings open suddenly. They do not provide increase resistance to the force that is pushing the door. Rather, they provide a means of absorbing the shock once the door has reached its maximum swing.

U.S. Pat. No. 3,538,539 (Allison), shows a door stop built into a hinge but there is no apparent resilience. There are several structures shown but in each case a fixed stop limits the motion of the door. The hinge pin can be moved to change the place at which the stop prevents further motion of the door but there is no spring. U.S. Pat. No. 3,178,762 (Whiting), appears to be similar to the Allison patent. There is a door stop but no proper spring. It should be noted that there is a frictional element which distorts the sleeve 12 as shown in FIGS. 2, 3, and 4 to give it a slight amount of spring. The purpose is not so much to bring the door to a gentle stop as it is to protect the life of the hinge.

SUMMARY OF THE INVENTION

It is the purpose of the applicant to provide a device which increases the resistance to a door swinging open rapidly as the door nears it maximum desired opening.

In a door having a standard door closing device and a standard door pivot arrangement a new spring type pivot is added to that pivot arrangement. The pivot comprises a vertical rod, a series of restraining plates, a series of coil springs, and a series of bolts. In a conventional door the pivot is just a small peg that extends from a collar, attached to the door, down to the floor or up to the top of the door frame. These small pegs are replaced in the applicant's invention by the vertical rod. The vertical rod is secured to the door and extends the full height of the door. The rod is secured at the top and the bottom of the door by the collars that in a conventional door hold the pegs that act as the pivots. The rod is preferably non-cylindrical, such as a standard square or hexagonal stock, so the collars can be locked on to the rod to turn the rod with the door. A cylindrical rod could also be used but regardless of the shape of the rod a set screw is used to insure that the rod is secured to the collars. The use of the set screw is absolutely necessary only if the rod is circular, otherwise the use of set screws is merely preferable.

At various heights along the rod a coil spring is wound around the rod. Each coil spring has a pair of elongated tails.

The tails rest against the door frame. A restraining plate having two channels which are generally perpendicular to the vertical rod, when mounted, is placed over the spring tails so that the spring tails rest in the channels of the restraining plate. The restraining plate is mounted to the door frame. The restraining plate holds the spring coils in position on the rod. The spring tails are moveable within the channels toward and away from the vertical rod.

At each point where a spring coil is attached to the rod a bolt projects out of the rod. As the door opens the collars cause the vertical rod to turn. This moves the bolts. When the door reaches approximately 70° to 80° of opening, the bolts come into contact with a portion of the spring coils. The springs are very heavy and require a great deal of force to be deflected as the opening of the door forces the bolt against that portion of the spring coil. Like all springs this action is gradual. A very tiny deflection produces a very tiny force. However the force produced by these springs increases very rapidly. As the volt pushes against the portion of the spring coil the spring tails are wound in around the vertical rod. The tails are of sufficient length so that they can never be completely drawn out of the channels of the restraining plate. This design results in the last few degrees of door movement producing a very strong force opposing further motion of the opening of the door where before there had been little or no force opposing the motion in the opening direction until the door reached about 80° of opening. Before that time the only forces opposing the opening of the door were those produced by the standard door closing device on the door that pulls it closed.

When the bolt comes into contact with the spring portion the tails push against the door frame as they were wound around the vertical rod. This action adds more tension to the springs on the rod and the force required to move the door open any further increases very rapidly, thus bringing the door to a halt and preventing it from being damaged whether it is opened by a gust of wind or by the human hand.

Alternatively, the structure of the hinge may be as follows. A flange is added to the door frame. The vertical rod and collars remain unchanged. At various heights along the rod a coil spring is attached. The coil spring is wound around the rod and has a hooked tail which is spaced from the door frame a calculated distance.

The coil springs are prevented from slipping on the rod by the use of a bolt as a stop. A bolt is driven in to the rod so that only the bolt head protrudes. The bolt head is in contact with a portion of the spring coil that is wound around a rod. The orientation of the bolt head and that spring portion in contact with it is such that as the door is opened the bolt head will push against the spring portion while as the door is closed the reverse occurs. This prevents the spring from slipping and losing its tension when the door is opened and closed.

When the door opens, the rod turns with the door because the collars that are attached to the door are secured to the rod by the non-circular shape of the rod and the set screws. The springs also turn because they are in contact with the bolt that is attached to the rod. Because the tail of the spring is spaced from the door frame it does not contact the door frame flange until the door is approximately 80 degrees from its closed position. At that point the tail of the spring contacts the flange attached to the door frame. The spring is very heavy and requires a great deal of force to be deflected as the opening of the door forces it against the door frame flange. Again, like all springs the action is gradual. A very tiny deflection produces a very tiny force. However the force produced by these springs increases very rapidly. As a result the last few degrees that the door moves produces a very strong force opposing further motion in the opening direction whereas there had been little or no force opposing motion in the opening direction until the door reached about 80 degrees of opening. Before that time the only forces opposing the opening of the door were those produced by the door closer which is adjusted for each operation. When the spring tail comes into contact with the door frame flange the force required to move the door further increases very rapidly, thus bringing the door to a gradual halt whether it is being opened by a gust of wind or by a human hand.

Should the force acting on the door be extremely large, the spring tail is also provided with a hook. This hook just barely clears the flange as the spring tail comes into contact with it. Normally the force of the spring itself will prevent the door from opening any further. However under extremely windy conditions the door could be pushed open to a point where the spring tail would become jammed between the flange and the door. This is prevented by the use of a hook. If the door is pushed with greater force that would cause the spring to wind or compress when the door is open, the hook will catch the edge of the flange and prevent the spring from compressing or winding any further. This also prevents the door from opening any further, even under very extreme conditions. The result is that even under extreme conditions the door is prevented from opening abruptly and thereby being damaged.

Both of the aforementioned versions of my invention offer many advantages over a conventional door stop. Unlike a door stop which acts suddenly, the force used here in opposing the opening of the door is applied in a graduated manner. The force can be graduated even more by arranging the various spring tails or bolts depending upon which embodiment of my invention is used, so that some of them strike the door frame flange or spring coils earlier than others. Likewise the strength of the spring can be changed so that some springs can be stronger than other springs. Finally, it is contemplated that the springs will be distributed along the height of the door so that the force opposing the door opening is distributed evenly all along the height. A door stop acts only at the bottom of a door or at the top of the door and causes the door to twist when it is hit hard. A chain acts only at the top of a door and causes the door to twist when it is hit hard. These springs, by being in place all along the entire height of the door, act evenly without causing it to twist.

Also, as many springs as needed may be placed on the rod to balance stress on the door and decelerate it enough to prevent breakage. The number of degrees of the door opens before a spring tail or bolt engages may vary. A spring tail or bolt might engage the flange 70 degrees, another at 80, and a third at 85 degrees. Likewise the spring force of each coil spring may vary. If desired both sets of characteristics may vary. The springs will always be stiff and strong enough to stop the door in a short time.

Finally in practice both embodiments of the spring hinge will be enclosed by a pair of arcuate interfitting covers. The covers protect the hinge mechanism from the elements. Also, because the covers are interfitting, one end of one cover may be attached to the door frame while one end of the other cover may be attached to the door with the two remaining ends interfitting with each other. This allows the door to be opened normally and the hinge mechanism to function properly without the need for any further modifications to the door, the door frame, or the hinge mechanism. The design is simple and elegant in its function.

Alternatively the invention may be described as a spring pivot device for impeding the progress of a door as it is swung open. The device comprises a vertical rod, a spring, a mounting plate for mounting the device to a door or door frame, and bolts for mounting the device to the door frame and for engaging a portion of the spring when the door is opened.

Preferably the spring has two tails that are parallel to each other. Each tail preferably having bent ends over which are mounted rollers. The device is normally mounted to the door so that the rollers are in rolling contact with the door frame. However, the device could just as easily be mounted in the reverse orientation. As the door is opened the rod mounted on the door rotates in relation to the degree to which the door is opened. The spring is mounted loosely on the rod so that it is relatively unaffected by the initial opening of the door and is not reeled in or compressed as the door opens initially. A bolt or similar structure is mounted on the rod in position to engage a portion of the spring. The spring rests on the rod but does not move or compress until the bolt mounted on the rod engages it. Once engaged the spring is reeled in or compressed onto the rod causing a significant increase in resistance to the opening of the door. In this embodiment any shape of rod may be used and the rod need not extend the whole length of the door; top to bottom.

Please note that the term "reeling" as used in this specification shall, in addition to its normal meaning, also mean compression.

DESCRIPTION OF THE DRAWINGS

FIG. 1 is a front elevational view of the unenclosed spring hinge.

FIG. 2 is a view from line 2—2 of FIG. 3.

FIG. 3 is a front elevational view of the unenclosed spring hinge showing one end of the rod being held by a collar.

FIG. 4 is a view from line 4—4 of FIG. 3.

FIG. 5 is a side elevational view of the unenclosed spring hinge.

FIG. 6 is a view from line 6—6 of FIG. 5.

FIG. 7 is a view from line 7—7 of FIG. 8.

FIG. 8 is perspective view of the door and the spring hinge.

FIG. 9 is a front elevational view of the door restraint mechanism.

FIG. 10 is a side right hand view of the door restraint mechanism.

FIG. 11 is a side left hand view of the door restraint mechanism.

FIG. 12 is a top elevational view of the door restraint mechanism mounted on a door.

DETAILED DESCRIPTION

Figure 1:
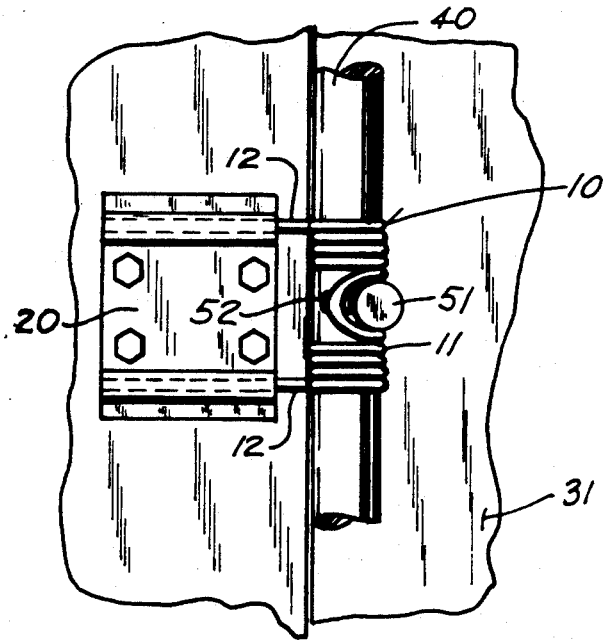
FIGS. 1 through 4 disclose the preferred embodiment of the present invention.
Figure 2:
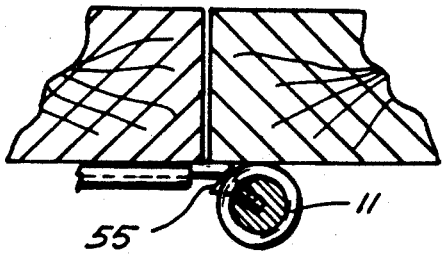

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

The preferred embodiment of my invention is a hinge 10. The hinge 10 is comprised of a restraining plate 20, coil springs 11, bolts 52, bolt heads 51, spring tails 12, a vertical rod 40, collars 50*a* and 50*b*, set screws 55, and a two-part interfitting shield 60.

The hinge 10 is a unique modification of a pintle hinge. However, the device of the invention is not limited to the general pintle structure. Any hinge structure could be replaced with or adapted to the structure of the applicant's invention.

The restraining plate 20 is secured to the door frame 30. See FIG. 3. The vertical rod 40 is preferably hexagonal in shape but is shown in FIGS. 1 through 4 as cylindrical. The rod 40 runs the entire length of the door 31.

Referring to FIGS. 1 through 4 the restraining plate 20 may be seen. The restraining plate 20 is bolted to the door frame 30. Although only one restraining plate 20 is shown in practice there will be as many plates 20 as there are springs 11. The plate 20 has two channels 21 and 22 which run generally perpendicular to the vertical rod 40. When the plate 20 is attached to the door frame 30 the channels form a space between the door frame 30 and the plate 20. This space holds the tails 12 of the coil springs 11.

Referring to FIGS. 1 through 4 again the springs coils 11 may be seen to be wound around the rod 40 at various intervals. Each spring coil 11 has a pair of tails 12 which are spaced apart and are inserted in the channels 21 and 22 of the restraining plate 20. The plate 20 maintains the position of the springs 11 on the rod 40. This prevents the spring coils 11 from slipping on the rod 40. The bolts 52 are inserted into the rod 40 at the same intervals that the spring coils 11 are attached to the rod 40. The bolt heads 51 protrude from the rod 40. Each bolt head 51 is positioned such that it will contact a portion of the spring coil 11 when the door 31 is at approximately 80° open. The orientation of each bolt head 51 and the portion of the spring coil 11 that it comes into contact with is such that as each bolt head 51 pushes against each spring coil 11 while the door 31 is being opened the spring tails 12 begin to wind around the rod 40.

The rod 40 turns the door 31 because the collar 50*a*, are attached to the door 31 at the top and the bottom of the door 31 and are secured to the rod 40 by set screws 55. The springs 11 do not turn until the bolt heads 51 comes into contact with them. When the springs 11 begin to turn causing the spring tails 12 resting in channels 21 and 22 to move and wind around the door frame 30. The springs 11 are very heavy and require a great deal of force to be deflected as the opening of the door 31 causes the bolt head 51 to come into contact with the spring 11. This action is gradual. A very small deflection produces a very small force.

The springs 11 are positioned at various points up and down the hinge 10. The bolts 52 may be set in the rod so that the bolt heads 51 come into contact with the portion of the springs 11 at the same time or a staggered times so that the spring tails 12 begin to wind around the rod 40 in either a graduated manner or at the same time.

As each bolt head 51 comes into contact with the spring 11 the force required to move the door 31 increases very rapidly causing the door 31 to a gradual halt regardless as to how it is being opened.

Alternatively, the device of my invention may be as follows.

A flange 90 is secured to the door frame 30. See FIG. 7. The rod 40 runs the entire length of the door 31.

Figure 7:
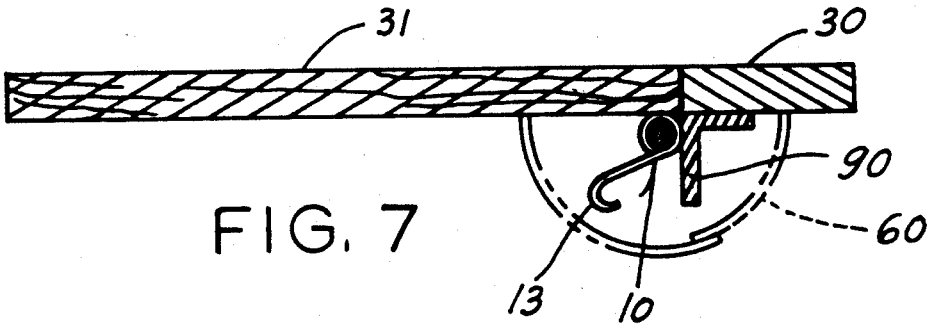
Figure 8:
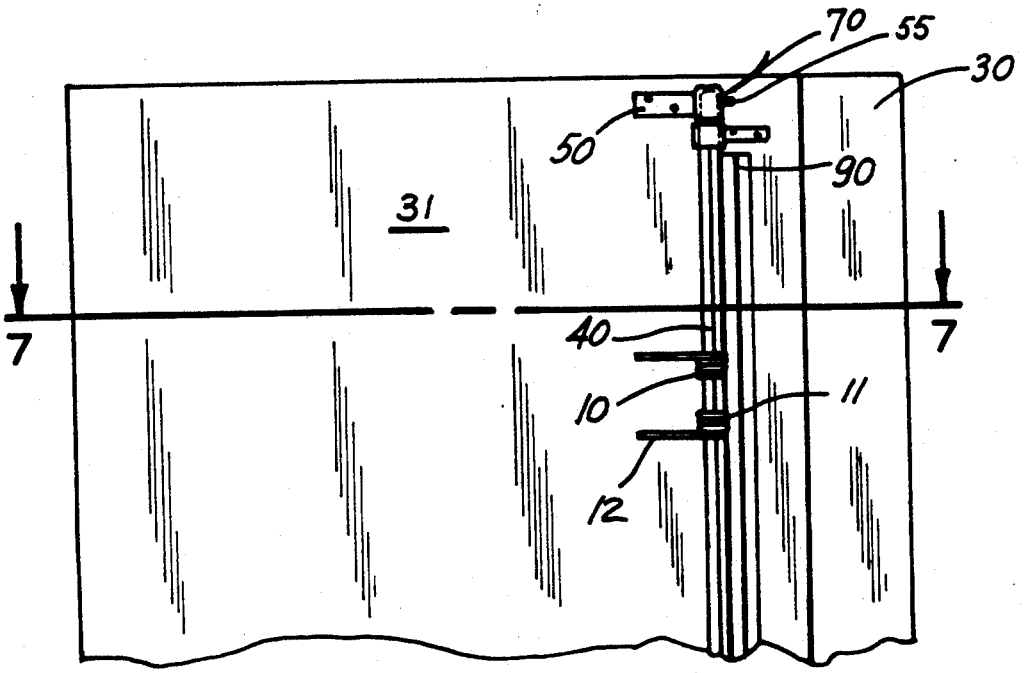
Figure 11:
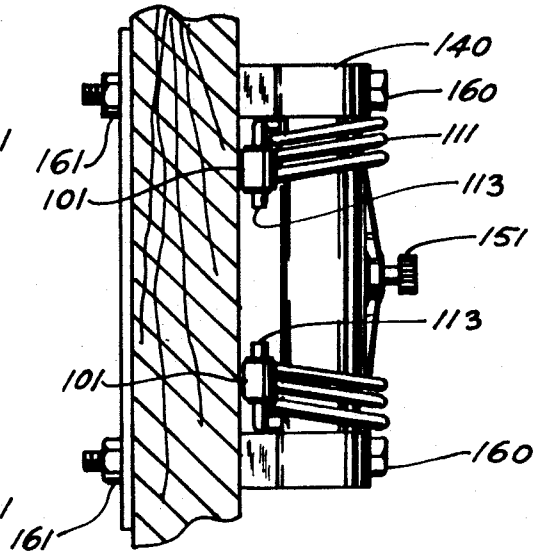
FIGS. 9 through 12 disclose an alternative embodiment of the present invention.
Figure 10:
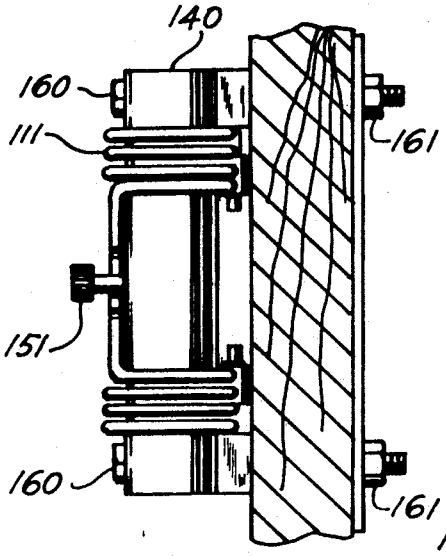
Figure 9:
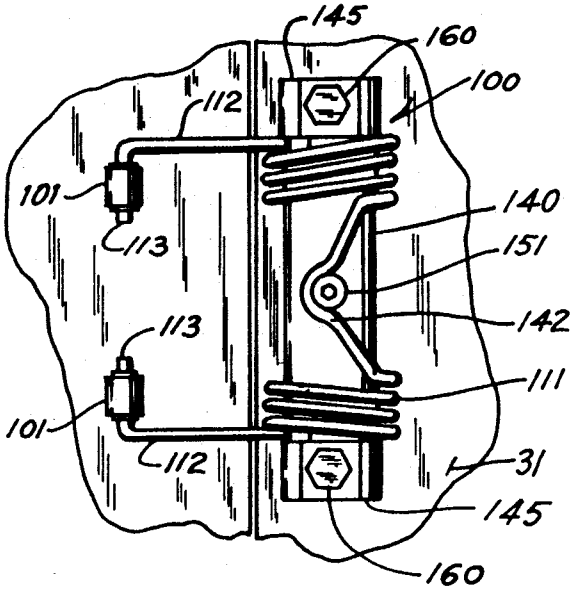
Figure 12:
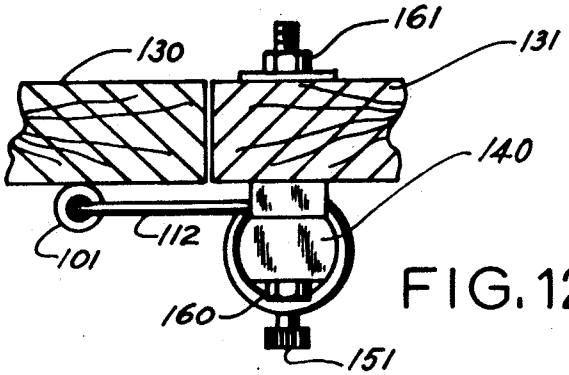

Referring to FIGS. 7 and 8 the spring coils 11 are wound around the rod 40. Each spring coil 11 has a tail 12 which is spaced a calculated distance from the flange 90. The end of each tail 12 is a hook 13. The spring coils 11 are prevented from slipping on the rod 40 as the door 31 opens and closes by means of the bolts 52. The bolts 52 are inserted into the rod 40 at the same intervals that the spring coils 11 are attached to the rod 40. The bolt heads 51 protrude from the rod 40. Each bolt head 51 remains in contact with a portion of the spring coil 11. The orientation of each bolt head 51 and the portion of the spring coil 11 that it is in contact with is such that the bolt head 51 pushes against of the spring coil 14 when the door 31 is being opened while the reverse occurs as the door 31 is closed. This prevents the spring coil 11 from slipping and losing its tension as the door 31 is opened and closed. When the door 31 opens the rod 40 turns with the door 31 because the collar 50*a*, that are attached to the door 31 at the top and bottom of the door 31, are secured to the rod 40 by the set screws 55 and the non-cylindrical shape of the rod 40. The springs 11 also turn because they are in contact with the bolt heads 51 of each bolt 52 that is attached to the rod 40. The tail 12 is spaced from the door frame 30 so that it does not strike the flange 90 that is fixed to the door frame 30 until the door 31 is approximately 80 degrees from its closed position. The springs 11 are very heavy and require a great deal of force to be deflected as the opening of the door 31 forces the spring tails 12 against the flange 90. This action is gradual. A very small deflection produces a very small force.

The springs 11 are positioned at various points up and down the hinge 10. The springs 11 may be set so that their tails 12 all come into contact with the flange 20 at the same time or they may be staggered so that their tails 12 come in to contact with flange 90 in a graduated manner.

As each tail 12 comes into contact with the flange 90 the force required to move the door 31 increases very rapidly causing the door 31 to come to a gradual halt regardless of how it is being opened. This is true because each hook 13 of each tail 12 just barely clears the edge of the flange 90; as each tail 12 comes into contact with the flange 90. The hook 13 is drawn down over the edge of the flange 90 if the force upon the door is extreme enough to cause the spring 11 to begin to wind in the tail 12. The hook 13 prevents the tail 12 from jamming between the spring 11 and the flange 90. The hook 13 also causes the spring 11 to lock and resist any further pressure from the door no matter how severe. Thus the door 31 cannot be pushed open any further as a result of the action of the hook 13.

If the hooks 13 are engaged the door 31 is not prevented from closing. As the door 31 begins to close the spring 11 begins to unwind a portion of the tail 12. This causes the hook 13 to rise enough to just clear the edge of the flange 90 thereby allowing the door 31 to close.

In both embodiments of the invention a two part interfitting shield 60 is preferably used.

Figure 3:
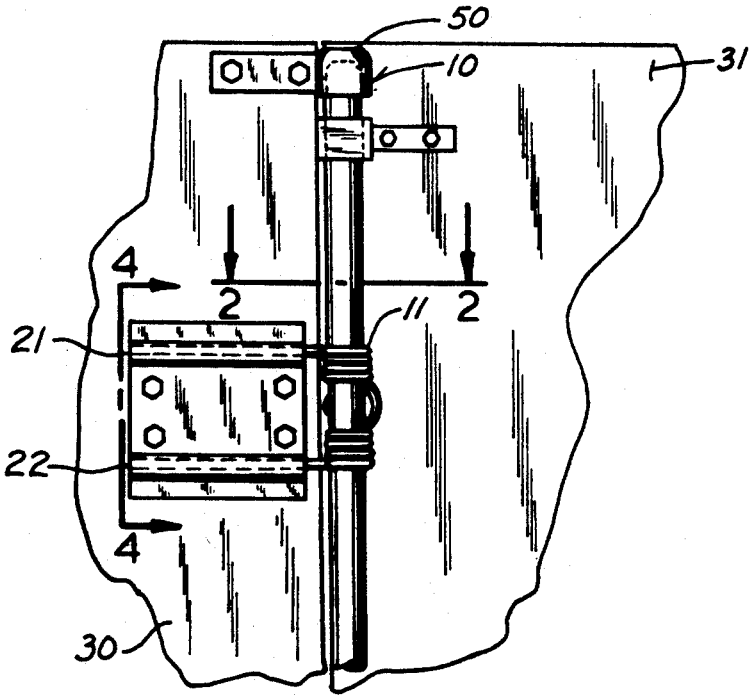
Figure 4:
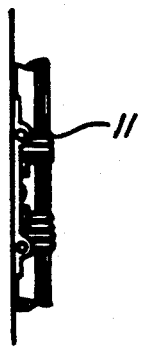
Figure 5:
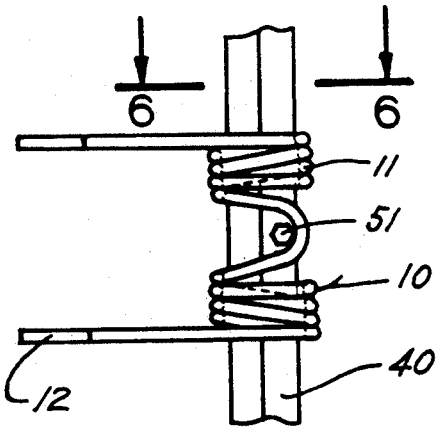
FIGS. 5 through 8 disclose an alternative embodiment of the present invention.
Figure 6:
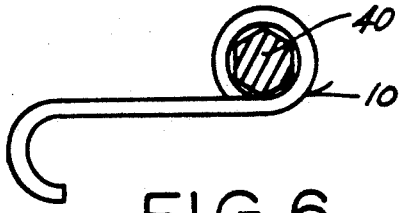

The two part interfitting shield 60 is shown in phantom in FIG. 3. The purpose of the shield is to protect the mechanism of the hinge 10. The shield 60 completely enclosed the hinge 10 from the top of the door 31 to the bottom of the door 31. The shield 60 is of a two part interfitting construction that allows the door to open and close without every allowing the mechanism of the hinge 10 to be exposed. Further, although the mechanism of the hinge 10 will work without the shield 60, the shield 60 acts as an additional stop that prevents the door from opening beyond the setting of the mechanism of the hinge 10.

FIGS. 9 through 12 disclose an alternative embodiment of the present invention. The door restraint device 100 comprises a coil spring 111, bolts 160, a bolt 151, spring tails 112, a short vertical rod 140, and two rollers 101 mounted on ends 113 of the spring tails 112.

As may be seen in FIGS. 9 through 12 the spring tails 112 are generally parallel to each other and have bent ends 113 over which are mounted the rollers 101. The spring 111 is loosely mounted over the rod 140. The rod 140 has enlarged ends 145 which keep the loosely mounted spring 111 in position on the rod 140. Accordingly, the rod 140 may turn independently of the spring 111 so that when the door 131 is initially opened the rod 140 will rotate and move in an arc that is the same as the arc of movement of the door 131. Accordingly, the initial resistance to opening the door 131 is either nonexistent or extremely minimal. However, bolt 151 is mounted on the rod 140 in such a position, as is illustrated in FIGS. 9 through 12, that it is able to engage portion 142 of the spring 111 after the door 131 has opened a predetermined distance.

When the bolt 151 engages the portion 142 of the spring 111 the rod 140 in conjunction with the door 131 acts as a reeling and compressing mechanism which begins to reel the loose spring 111 down onto the rod 140. The rollers 101 located on the ends 113 of the spring tails 112 act to reduce damage to the door frame 130 and to make the movement of the spring coil 111 onto the rod 140 smooth. This reeling and compressing action creates a marked increase in the resistance to the opening of the door 131 and prevents the door 131 from being hurled open, due to high winds and the like, where it could be damaged.

The above described embodiments of this invention are merely descriptive of its principles and are not to be limiting. The scope of this invention instead shall be determined from the scope of the following claims, including their equivalents.

What is claimed is:

1. A spring loaded hinge for a door having a door frame comprising:

a generally vertical rod that moves with said door as said door pivots;

a first collar means for holding said rod to said door;

a second collar means for holding said rod to said door frame;

at least one spring means attached to said rod at various intervals;

moving means for moving said spring means with said rod;

said rod extending substantially from the top of said door to the bottom of said door;

said moving means being attached to said rod at generally the same said intervals of said spring means;

each said spring means having a portion in contact with said moving means;

each said spring means having a free end;

each said free end of each said spring means being oriented in a direction such that as said door opens said portion of each said spring means causing said free end of said spring means to move as said vertical rod rotates such that as said door opens each said free end of each said spring means contacts said door frame when said door is nearly fully opened and thereafter applies increasing force to said rod through said moving means eventually preventing rotation of said rod whereby said door is prevented from being opened any further.

2. The device of claim 1 in which said hinge is covered by a two-part interfitting shield.

3. The device of claim 1 in which said door frame has a flange;

said flange being at an angle to said door;

said free end of said coil spring contacting said flange as said door pivots on said hinge.

4. The device of claim 3 in which said free ends have hooks capable of engaging said door frame flange.

5. The device of claim 1 in which said first collar means have set screws for holding said rod.

6. A spring load door hinge for a door having a frame comprising;

a full height vertical rod that moves with said door as said door pivots;

a first collar means for holding said door to said rod;

a second collar means for holding said door frame to said rod;

a plurality of spring means attached to said vertical rod at various intervals;

moving means for moving against a portion of said spring means;

said moving means being attached to said rod at the same said intervals as said spring means;

each said spring means having a portion in contact with said moving means and a free end spaced from said door and oriented in a direction such that as said door opens said free end of said spring means touches said door frame when said door is nearly full opened and thereafter applies increasing force to said rod thus preventing further rotation of said door and said rod.

7. A spring loaded door hinge for a door having a door frame comprising:

a full height vertical rod;

a first set of collars for holding said rod to said door;

a second set of collars for holding said rod to said door frame;

a plurality of coil springs;

a flange attached to said door frame;

a plurality of bolts;

said coil springs being attached to said rod at various intervals;

each said coil spring having a hooked tail;

said bolts being attached to said rod at the same said intervals as said coil springs;

each said coil spring having a portion in contact with each said bolt;

each said hooked tail of each said spring coil being oriented in a direction such that as said door opens. said portion of each said coil spring in contact with each said bolt pushes against each said bolt as said door is opened causing each said hooked tail to move as said vertical rod rotates such that each said hooked end contacts said flange when said door is nearly fully opened and thereafter applies increasing force to said rod through said moving means, eventually preventing rotation of said rod whereby said door is prevented from being opened any further.

8. A spring loaded hinge from a door having a door frame comprising:

a generally vertical rod that moves with said door as said door pivots;

spring means for preventing said door from slamming open;

holding means for holding said spring means in place;

moving means for increasing the tension of said spring means;

said spring means having at least two tails;

said tails being held against said door frame by said holding means;

said tails in said holding means being capable of winding around said rod;

said moving means being capable of contacting a portion of said spring means;

said moving means being attached to said vertical rod;

said spring means being in contact with said vertical rod at various intervals;

said moving means being attached to said rod at the same intervals that said spring means is in contact with said rod;

a part of said spring means portion in contact with said rod being capable of being contacted by said moving means;

said rod being connected to said door by a collar means;

whereby as said door opens said rod turns causing said moving means to contact said part of said portion of said spring means thereby increasing the tension of said spring means and bringing said door to a gradual halt at which point it can be opened no further.

9. The device of claim 8 in which said hinge is covered by a two-part interfitting shield.

10. A spring loaded hinge for a door having a door frame comprising:

a generally vertical rod that moves with said door as said door pivots;

a first collar means for holding said rod to said door;

a second collar means for holding said rod to said door frame;

at least one spring means attached to said rod at various intervals;

moving means for moving said spring means with said rod;

said rod extending substantially from the top of said door to the bottom of said door;

said moving means being attached to said rod at generally the same said intervals of said spring means;

each said spring means having a portion in contact with said moving means;

each said spring means having a free end;

each said free end of each said spring means being oriented in a direction such that as said door opens said portion of each said spring means causing said free end of said spring means to move as said vertical rod rotates such that as said door opens each said free end of each said spring means contacts said door frame when said door is nearly fully opened and thereafter applies increasing force to said rod through said moving means eventually preventing rotation of said rod whereby said door is prevented from being opened any further;

said door frame having a flange;

said flange being at an angle to said door;

said free end of said coil spring contacting said flange as said door pivots on said hinge;

said free ends having hooks capable of engaging said door frame flange.

11. A spring loaded hinge for a door having a door frame comprising:

a generally vertical rod that moves with said door as said door pivots;

a first collar means for holding said rod to said door;

a second collar means for holding said rod to said door frame;

at least one spring means attached to said rod at various intervals;

moving means for moving said spring means with said rod;

said hinge is covered by a two-part interfitting shield;

said rod extending substantially from the top of said door to the bottom of said door;

said moving means being attached to said rod at generally the same said intervals of said spring means;

each said spring means having a portion in contact with said moving means;

each said spring means having a free end;

each said free end of each said spring means being oriented in a direction such that as said door opens said portion of each said spring means causing said free end of said spring means to move as said vertical rod rotates such that as said door opens each said free end of each said spring means contacts said door frame when said door is nearly fully opened and thereafter applies increasing force to said rod through said moving means eventually preventing rotation of said rod whereby said door is prevented from being opened any further.

12. The device of claim 11 in which said free ends of said spring means have tips and include ends having a roller means for rolling said tips against said door frame.

13. A spring loaded pivot for a door having a frame, for preventing a door from swinging open more than a predetermined distance and for reducing the rate of speed at which the door swings open as it approaches the predetermined distance, said spring loaded pivot for a door having a frame comprising:

a generally vertical rod mounted to said door frame by mounting means;

at least one spring means, loosely mounted on said generally vertical rod, for resisting the opening of said door after said door has swung open said predetermined distance;

reeling means for reeling said spring means around said rod;

said reeling means engageable with a portion of said spring means;

said spring means having tail means for engaging said door;

said tail means of said spring means being oriented in a direction such that, as said door is opened, said reeling means comes into contact with said portion of said spring means;

whereby said reeling means pushes against said portion of said spring means causing said tail means of said spring means to press against said door when said door is in a predetermined open position;

thereafter said spring means applies increasing resistance through said reeling means and thereby against the movement of said door eventually preventing said door from opening any further.

14. The device of claim 13 in which said tail means of said spring means have tips and include ends having a roller means for rolling said tips against said door.

* * * * *